US006871569B1

(12) United States Patent
Chen

(10) Patent No.: US 6,871,569 B1
(45) Date of Patent: Mar. 29, 2005

(54) TOOL HAVING ROTATABLE DRIVING HEAD

(76) Inventor: Chia Yu Chen, P.O. Box 63-99, Taichung, 406 (TW)

( * ) Notice: Subject to any disclaimer, the term of this patent is extended or adjusted under 35 U.S.C. 154(b) by 0 days.

(21) Appl. No.: 10/656,634

(22) Filed: Sep. 4, 2003

(51) Int. Cl.[7] ..... B25B 13/46; B25B 23/16
(52) U.S. Cl. ..... 81/57.39; 81/177.8; 81/177.7
(58) Field of Search ..... 81/57.39, 58, 58.1, 81/58.5, 177.2, 177.5–177.9, 60–63.2, 489

(56) References Cited

U.S. PATENT DOCUMENTS 1,080,121 A * 12/1913 Oriol ..... 81/177.8
4,463,632 A 8/1984 Parke ..... 81/177.9
4,901,608 A 2/1990 Shieh ..... 81/177.8
5,862,723 A * 1/1999 Rowlands ..... 81/177.9
6,000,302 A 12/1999 Chiang ..... 81/177.8
6,216,567 B1 * 4/2001 Hu ..... 81/177.9
6,336,383 B1 * 1/2002 Hung ..... 81/60
2004/0007102 A1 * 1/2004 Wilhelm ..... 81/177.85
2004/0040423 A1 * 3/2004 Hung ..... 81/177.75

* cited by examiner

*Primary Examiner*—David B. Thomas

(57) ABSTRACT

A tool includes a handle having a cavity to slidably receive a latch, and a driving head having a shank rotatably secured to the handle with a shaft. The shank includes a number of depressions formed in an outer peripheral portion and extended into the cavity of the handle. The latch includes a stem having a reduced outer diameter and includes an actuator to selectively engaged into either of the depressions of the shank of the driving head. A spring may bias the actuator to engage into either of the depressions of the shank of the driving head, and to adjustably secure the driving head to the handle at selected angular position.

1 Claim, 6 Drawing Sheets

TOOL HAVING ROTATABLE DRIVING HEAD

BACKGROUND OF THE INVENTION

1. Field of the Invention

The present invention relates to a tool, and more particularly to a tool having a rotatable driving head to be adjustably secured to the tool handle with a simplified lock device.

2. Description of the Prior Art

Various kinds of typical tools have been developed and comprise a rotatable driving head provided thereon and adjustable to different angular positions relative to the handle, and selectively lockable to the handle with a lock device.

For example, U.S. Pat. No. 4,463,632 to Parke, and U.S. Pat. No. 6,336,383 to Hung disclose two of the typical tools including a rotatable driving head adjustably secured to the handle, and selectively lockable to the handle with a latch device. The latch device may actuate a ball to engage with and to lock the driving head to the handle.

However, the ball may include only a small curved line or even a point in contact with the driving head, such that the driving head may not be powerfully driven by the handle.

U.S. Pat. No. 6,000,302 to Chiang discloses another typical tools including a rotatable driving head adjustably secured to the handle, and selectively lockable to the handle with a latch device. The latch device may actuate a pawl to engage with and to lock the driving head to the handle.

The ball may include a greater contact area with the driving head than the prior ball structure. However, the pawl may also be easily forced or moved away from the driving head when the driving head is rotated relative to the handle.

U.S. Pat. No. 4,901,608 to Shieh discloses a further typical tools including a rotatable driving head adjustably secured to the handle, and selectively lockable to the handle with a button. The button includes a gear attached thereon and may actuate the gear to engage with and to lock the driving head to the handle.

However, the engagement between the gear and the teeth of the driving head is weak; i.e., the gear may not be solidly engaged with the teeth of the driving head and the gear teeth may be easily damaged, such that the driving torque of the handle onto the driving head may not reach or fulfill the requirement of the users.

The present invention has arisen to mitigate and/or obviate the afore-described disadvantages of the conventional tools having rotatable driving heads.

SUMMARY OF THE INVENTION

The primary objective of the present invention is to provide a tool having a rotatable driving head that may be adjustably secured to the tool handle with a simplified lock device.

In accordance with one aspect of the invention, there is provided a tool comprising a handle including a cavity formed therein, a driving head including a shank rotatably secured to the handle with a shaft, and the shank including an outer peripheral portion having a plurality of depressions formed between teeth, the outer peripheral portion and the teeth of the shank of the driving head being extended into the cavity of the handle, a latch slidably received in the cavity of the handle, and including a stem having a reduced outer diameter formed therein to form an outer peripheral recess therein and to receive the outer peripheral portion and the teeth of the shank of the driving head, the latch including an actuator provided thereon and having an outer diameter greater than that of the stem, to selectively engaged into either of the depressions of the shank of the driving head, and means for biasing the actuator to engage into either of the depressions of the shank of the driving head, and to adjustably secure the driving head to the handle at selected angular position.

The latch includes a first end having a disc provided thereon and a second end having a button provided thereon, and the disc and the button include an outer diameter equals to an inner diameter of the cavity of the handle, to snugly receive the disc and the button in the cavity of the handle.

The actuator of the latch includes an inclined side portion to allow the actuator to be easily engaged into either of the depressions of the shank of the driving head.

The handle includes a space formed between a first flap and a second flap, to rotatably receive the shank of the driving head, the space of the handle is communicating with the cavity of the handle to receive the outer peripheral portion and the teeth of the shank of the driving head.

The first flap includes an orifice formed therein to receive the shaft, and the second flap includes a screw hole formed therein, the shaft includes a threaded segment to thread with the screw hole of the second flap and to rotatably secure the driving head to the handle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
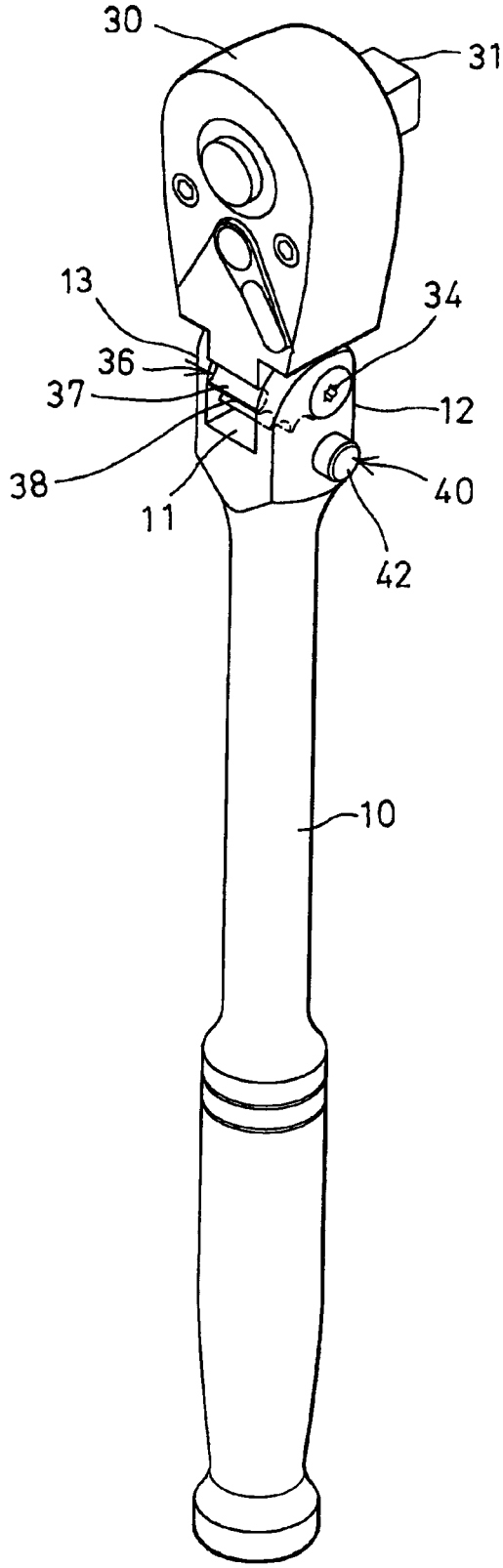
FIG. 1 is a perspective view of a tool having a rotatable driving head in accordance with the present invention.
Figure 2:
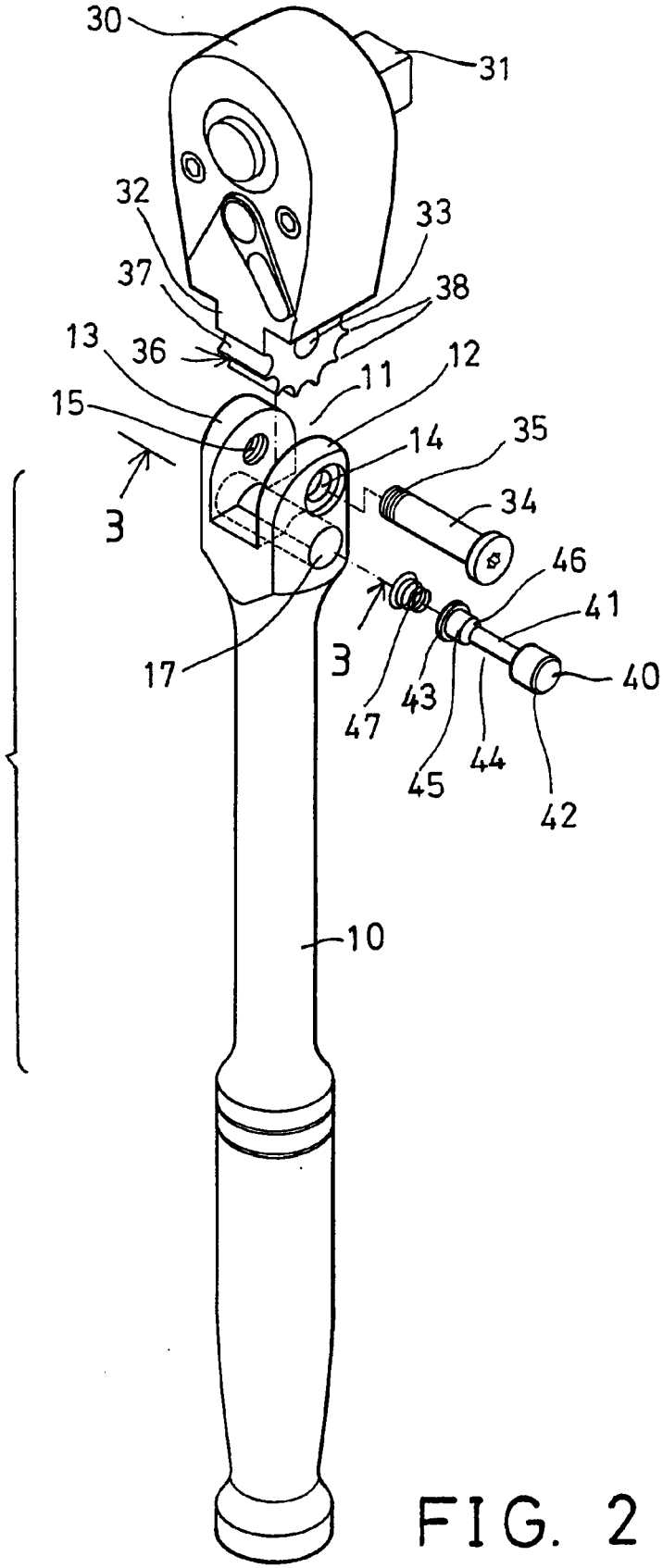
FIG. 2 is a partial exploded view of the tool having the rotatable driving head.

Referring to the drawings, and initially to FIGS. 1–5, a tool in accordance with the present invention comprises a handle 10 including a space 11 formed in one end thereof, and formed or defined by a pair of flaps 12, 13. One of the flaps 12 includes an orifice 14 formed therein, and the other flap 13 includes a screw hole 15 formed therein.

Figure 8:
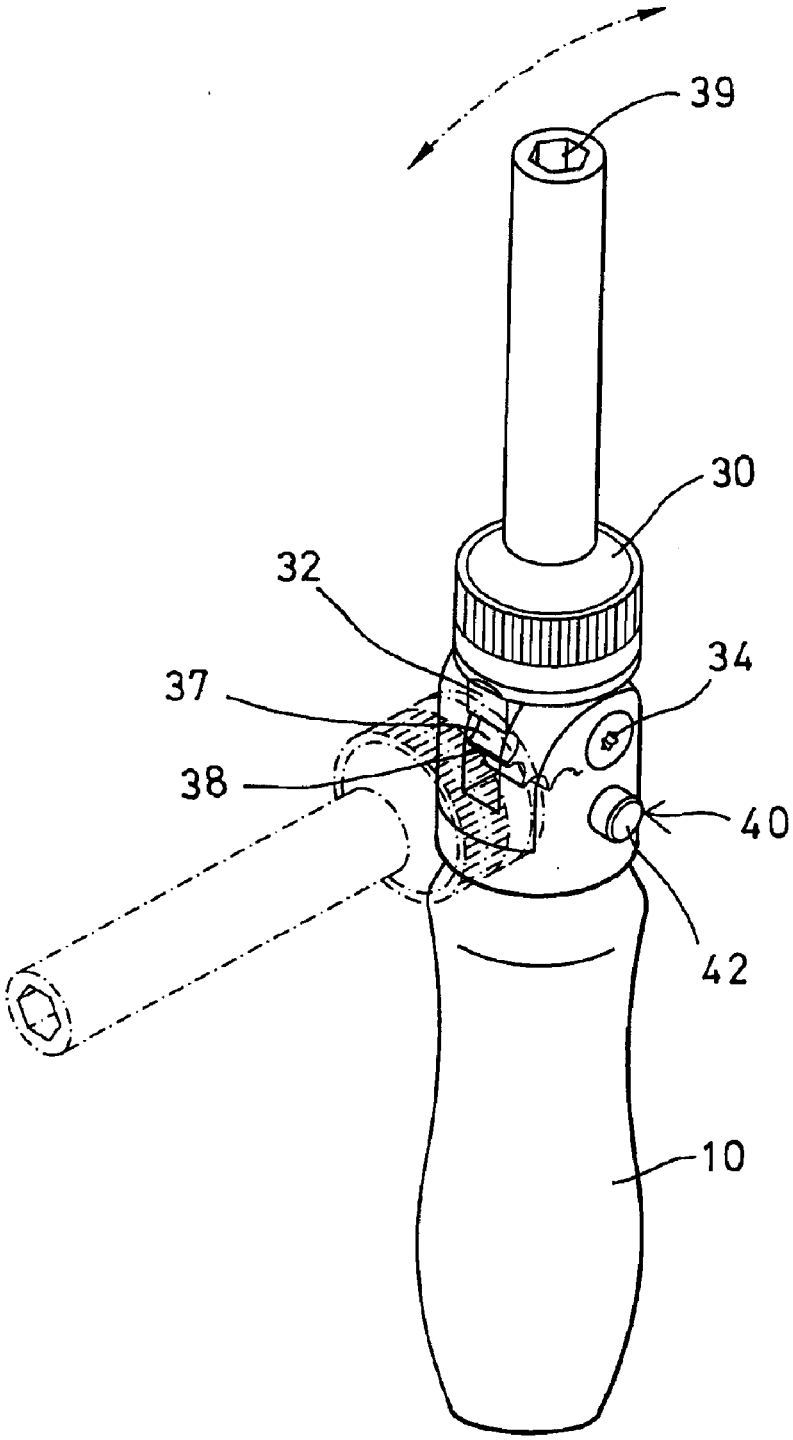
FIG. 8 is a perspective view illustrating the other arrangement of the tool having a rotatable driving head.

A rotatable driving head 30 includes a driving member 31 for engaging with and for driving fasteners, tool extensions, sockets (not shown) or the like, and includes a shank 32 received in the space 11 of the handle 10, and having an aperture 33 formed therein, for aligning with the orifice 14 and the screw hole 15 of the flaps 12, 13 respectively. The driving head 30 may also include an engaging hole 39 formed therein (FIG. 8) for engaging with and for driving fasteners, tool extensions (not shown) or the like.

A shaft 34 is engaged through the orifice 14 of the flap 12, and engaged through the aperture 33 of the shank 32 or of the driving head 30, and includes a threaded segment 35 for threading with the screw hole 15 of the flap 13, to rotatably or pivotally secure the driving head 30 to the handle 10, and thus for allowing the driving head 30 to be rotated relative to the handle 10 to any suitable angular positions.

The shank 32 of the driving head 30 includes a number of curved depressions 37 formed in the outer peripheral portion 36 thereof and formed or defined by a number of teeth 38. It is preferable that the curved depressions 37 and the teeth 38 of the shank 32 are parallel to the shaft 34, but perpendicular to the driving member 31 of the driving head 30.

Figure 3:
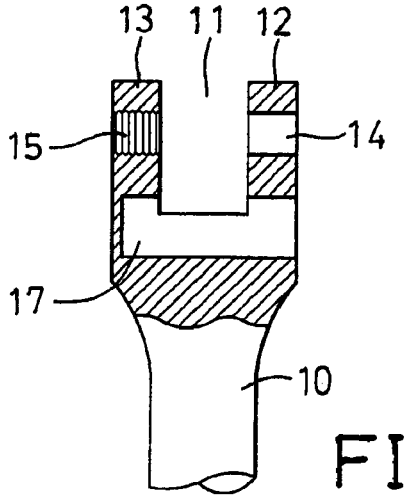
FIG. 3 is a partial cross sectional view taken along lines 3—3 of FIG. 2.

The handle 10 further includes a cavity 17 laterally formed therein, and preferably parallel to the shaft 34, or parallel to the orifice 14 and the screw hole 15 of the flaps 12, 13, and partially communicating with the space 11 of the handle 10, best shown in FIG. 3. As best shown in FIGS. 4–7, the outer peripheral portion 36 of the shank 32 of the driving head 30 is extended into the cavity 17 of the handle 10.

A latch 40 includes a stem 41 formed in the middle portion thereof, or defined between an outer button 42 and an inner disc 43. The stem 41 includes an outer diameter smaller than that of the outer button 42 and the inner disc 43 of the latch 40, to form an annular or outer peripheral recess 44 between the latch 40 and the handle 10 when the latch 40 is slidably and/or rotatably received in the cavity 17 of the handle 10, best shown in FIGS. 2, 4, and 6.

Figure 6:
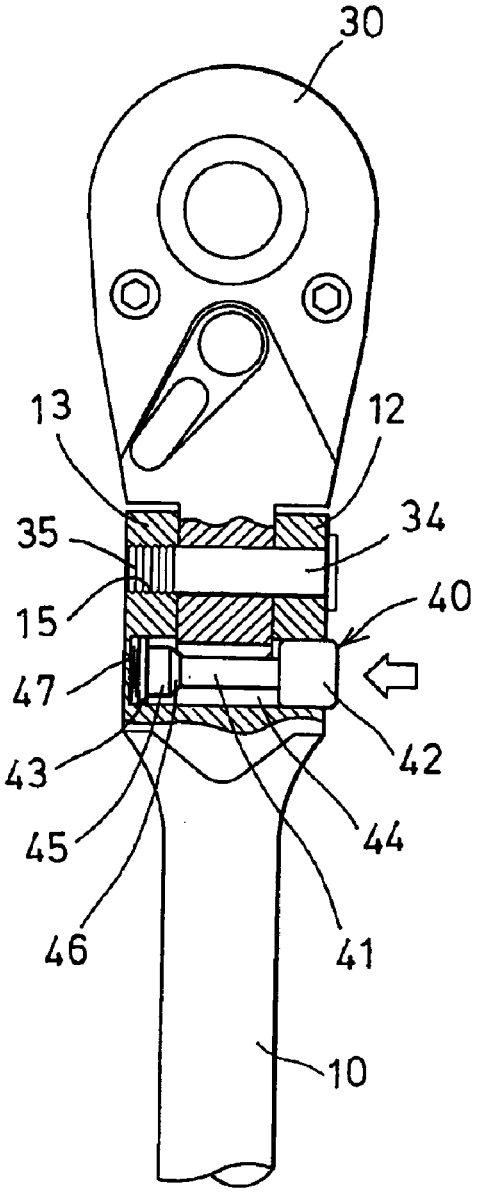
FIGS. 6, 7 are partial cross sectional views similar to FIGS. 4 and 5 respectively, illustrating the operation of the tool having a rotatable driving head.
Figure 7:
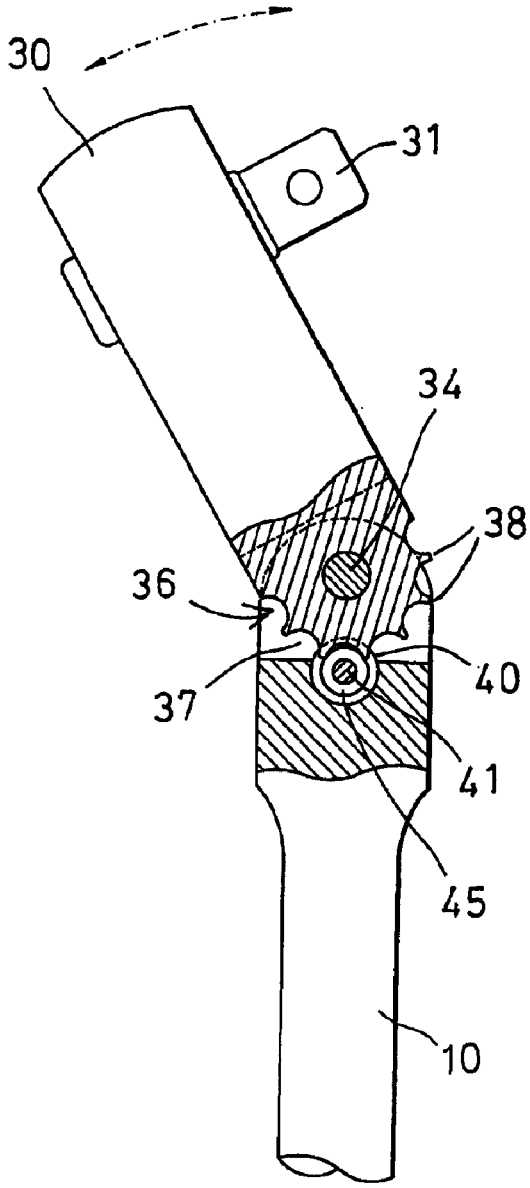

It is preferable that the outer button 42 and the inner disc 43 of the latch 40 include an outer diameter equals to the inner diameter of the cavity 17 of the handle 10, to allow the latch 40 to be smoothly slid and/or rotated relative to the handle 10, but for preventing latch 40 from being vibrated or shacken relative to the handle 10. The outer diameter of the stem 41 is arranged to prevent the stem 41 from being contacted with or engaged with the teeth 38 or the outer peripheral portion 36 of the shank 32 of the driving head 30 (FIGS. 6, 7).

The latch 40 further includes an actuator 45 formed or provided on one end of the stem 41, and located closer to or beside the disc 43, and having an outer diameter smaller than that of the outer button 42 and the inner disc 43 of the latch 40, but greater than that of the stem 41, to allow the actuator 45 to be selectively engaged into either of the curved depressions 37 that are formed in the outer peripheral portion 36 of the shank 32 of the driving head 30.

A spring 45 is received in the cavity 17 of the handle 10, and engaged with the latch 40, for biasing the button 42 of the latch 40 to partially extended out of the cavity 17 of the handle 10, and for biasing the actuator 45 to selectively engage into either of the curved depressions 37 of the shank 32 of the driving head 30 (FIGS. 4, 5), and thus to adjustably secure the driving head 30 to any suitable or selected angular position relative to the handle 10.

It is preferable that the actuator 45 of the latch 40 includes an outer diameter or an outer curvature corresponding to that of the curved depressions 37 of the shank 32 of the driving head 30, for allowing the actuator 45 of the latch 40 to be snugly received in the curved depressions 37 of the shank 32 of the driving head 30 (FIGS. 4, 5), and thus to greatly increase the driving torque applied to the driving head 30 by the handle 10.

Figure 4:
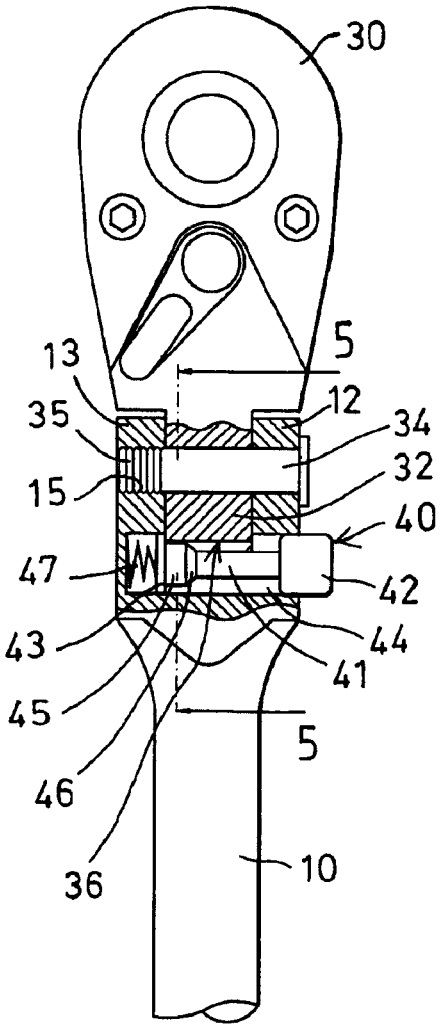
FIG. 4 is a partial cross sectional view taken along lines 4—4 of FIG. 5.
Figure 5:
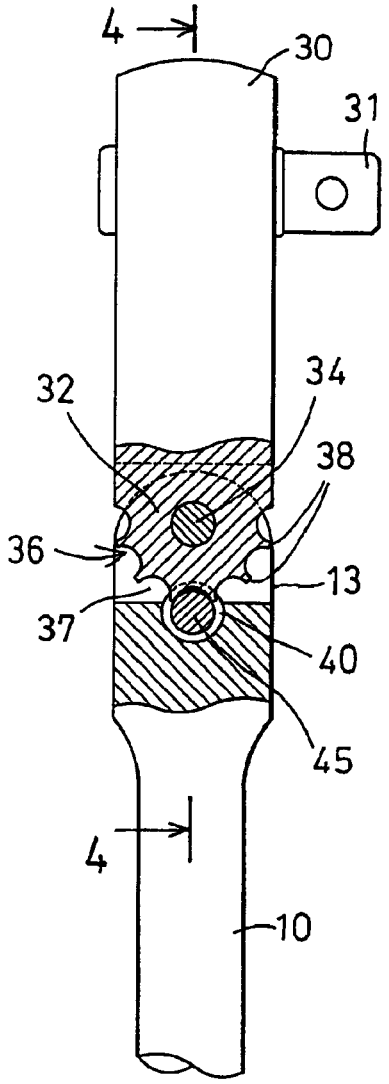
FIG. 5 is a partial cross sectional view taken along lines 5—5 of FIG. 4.

As also shown in FIG. 4, the outer peripheral portion 36 of the shank 32 of the driving head 30 is extended into the cavity 17 of the handle 10, and the inner disc 43 of the latch 40 is snugly received in the cavity 17 of the handle 10, such that the disc 43 of the latch 40 will be engaged with the outer peripheral portion 36 of the shank 32 of the driving head 30, and such that the latch 40 may be limited to move relative to the handle 10, and may be prevented from being disengaged from the handle 10.

It is also preferable that the actuator 45 of the latch 40 includes a tapered or inclined or curved or rounded side portion 46 for allowing the actuator 45 to be easily engaged into either of the curved depressions 37 of the shank 32 of the driving head 30, and to be engaged with the teeth 38 of the shank 32.

When it is required to rotate or adjust the driving head 30 relative to the handle 10, as shown in FIGS. 6 and 7, it is only required to depress the latch 40 into the cavity 17 of the handle 10, and to disengage the actuator 45 from the curved depressions 37 and the teeth 38 of the shank 32 of the driving head 30. The actuator 45 may be biased by the spring 47, to engage into the other curved depressions 37 of the shank 32 of the driving head 30, and to be engaged with the teeth 38 of the shank 32, to adjustably lock the driving head 30 to the handle 10 at any suitable or selected angular position.

The latch 40 includes a greatly simplified configuration having the actuator 45 integrally formed thereon, and may thus be easily engaged and assembled into the cavity 17 of the handle 10 before the shank 32 of the driving head 30 is engaged into the space 11 and the cavity 17 of the handle 10.

Figure 9:
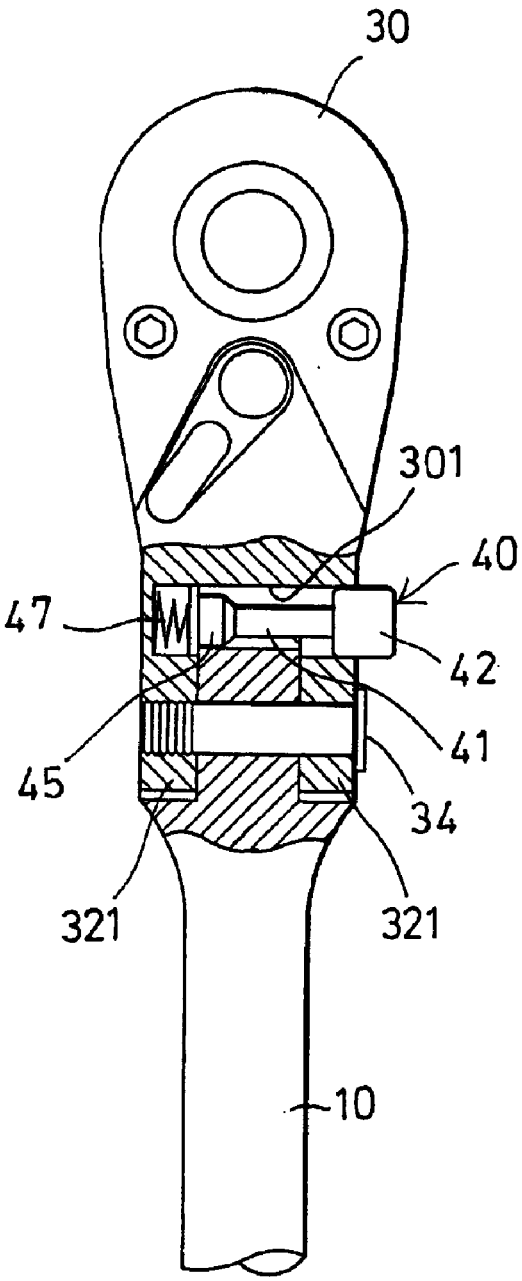
FIGS. 9, 10 are partial cross sectional views similar to FIGS. 4, 5; and 6, 7 respectively, illustrating the other embodiment of the tool having a rotatable driving head.
Figure 10:
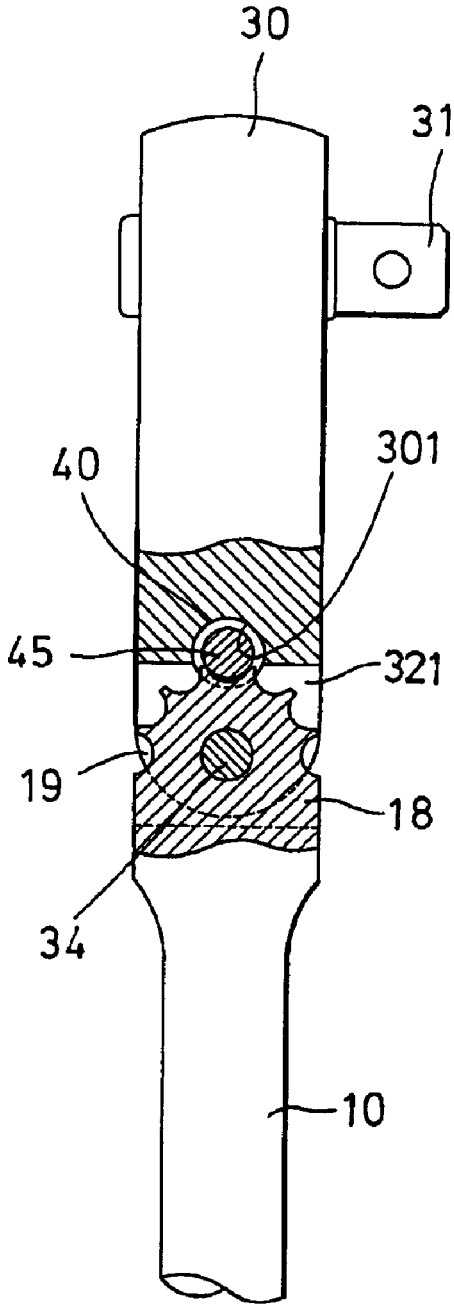

Referring next to FIGS. 9 and 10, alternatively, the handle 10 may include a shank 18 rotatably engaged into a space formed or defined between a pair of flaps 321 of the driving head 30, and the driving head 30 includes a cavity 301 formed therein to slidably receive the spring 47 and the latch 40. The latch 40 also includes an actuator 45 integrally formed thereon for engaging with either of the curved depressions 19 of the shank 18 of the handle 10, in order to adjustably lock the driving head 30 to the handle 10 at any suitable or selected angular position.

Accordingly, the tool in accordance with the present invention may be adjustably secured to the tool handle with a simplified lock device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a handle including a cavity formed therein, and including a space formed between a first flap and a second flap, and communicating with said cavity of said handle, said first flap of said handle including an orifice formed therein, and said second flap of said handle including a screw hole formed therein, a driving head including a shank rotatably secured to said handle with a shaft, and said shank including an outer peripheral portion having a plurality of depressions formed between teeth, said outer peripheral portion and said teeth of said shank of said driving head being received in said space of said handle, and being extended into said cavity of said handle, said shaft being engaged into said orifice of said first flap, and including a threaded segment to thread with said screw hole of said second flap and to rotatable secure said driving head to said handle, a latch slidably received in said cavity of said handle, and including a stem having a reduced outer diameter formed therein to form an outer peripheral recess therein and to receive said outer peripheral portion and said teeth of said shank of said driving head, said latch including a first end having a disc and an actuator provided thereon and a second end having a button provided thereon, said actuator including an outer diameter greater than that of said stem, to selectively engaged into either of said depressions of said shank of said driving head, and said actuator including an inclined side portion to allow said actuator to be easily engaged into either of said depressions of said shank of said driving head, said disc and said button including an outer diameter equals to an inner diameter of said cavity of said handle, to snugly receive said disc and said button in said cavity of said handle, and means for biasing said actuator to engage into either of said depressions of said shank of said driving head, and to adjustably secure said driving head to said handle at selected angular position.

* * * * *